United States Patent [19]

Cohen

[11] 3,994,640

[45] Nov. 30, 1976

[54] SPHERICAL ROTARY STEAM ENGINE

[75] Inventor: William A. Cohen, Brooklyn, N.Y.

[73] Assignee: Sphero International Co., Brooklyn, N.Y.

[22] Filed: Nov. 18, 1975

[21] Appl. No.: 632,964

[52] U.S. Cl. ..... 418/68

[51] Int. Cl.[2] ..... F01C 3/00

[58] Field of Search ..... 418/68; 123/8.45

[56] References Cited

UNITED STATES PATENTS

| | | | |
|---|---|---|---|
| 1,880,131 | 9/1932 | Gray | 418/68 |
| 2,043,544 | 6/1936 | Kempthorne | 418/68 X |
| 2,069,646 | 2/1937 | Cohen | 123/8.45 |
| 3,176,667 | 4/1965 | Hammer | 123/43 R |
| 3,549,286 | 12/1970 | Moriarty | 418/68 X |
| 3,934,559 | 1/1976 | Cohen | 123/8.45 |

*Primary Examiner*—Carlton R. Croyle
*Assistant Examiner*—Michael Koczo, Jr.

[57] ABSTRACT

The engine includes a housing defining a spherical cavity therein. A cylindrical member, rotatably mounted within the cavity, is driven by a drive member movably mounted within the cylindrical member. The cylindrical member, the drive member and the internal wall of the cavity define an expansion-compression chamber. Steam intake and steam exhaust manifolds are provided in the housing at spaced positions adjacent the cavity. The cylindrical member is provided with a steam passage therein which, in at least one rotational position of the cylindrical member, operatively connects the expansion-compression chamber to the intake manifold and in at least one other rotational position thereof operatively connects the expansion-compression chamber to the exhaust manifold. An output shaft is rotatably mounted within the housing and connected to the cylindrical member to be driven thereby. A circular ring valve is interposed between the cylindrical member and the intake and exhaust manifolds, respectively, to vary the comparative durations of the intake to and exhaust from the expansion-compression chamber of the cylindrical member. A secondary exhaust route is provided comprising an internal exhaust chamber formed in the drive member which, by means of an exhaust port and a valve sleeve, is conditionally connectable to the expansion-compression chamber. The valve sleeve has a part engageable with the cylindrical member such that the sleeve is moved relative to the drive member to open and close the exhaust port as the drive member moves relative to the cylindrical member. The exhaust chamber of the drive member is connected to an exhaust conduit extending into the cavity and about which the drive member rotates. This secondary exhaust route eliminates back pressure when the ring valve is positioned for late steam cutoff.

37 Claims, 15 Drawing Figures

SPHERICAL ROTARY STEAM ENGINE

The present invention relates to steam engines and, in particular, to a spherical rotary steam engine.

Steam engines of the reciprocating variety have been utilized in many different applications throughout the years. Common uses for steam engines have included providing power for driving locomotives, electrical generators and, at one time, automotive vehicles. Ideally, steam engines which are external combustion engines, exhibit advantages over other types of engines, for instance, internal combustion engines, in that they require lower grade fuels, are generally more efficient, and are simpler to manufacture and maintain.

Reciprocating steam engines, however, in practice, are prone to vibrate, are noisy and require complex sets of valves and valve gearing to regulate the intake and exhaust of steam which, because of their physical limitations, are awkward and inefficient and, in addition, may limit the steam cutoff point, thereby somewhat reducing the economy and versatility of the engine. Further, because of restrictions in the steam passages in and around the valves and in the valve ports themselves, as well as the sluggish action of the valves in opening and closing, a considerably reduction in efficiency may occur. The ideal situation would, of course, be a steam engine which does not require the continuous opening and closing of valves in order to permit steam intake to, and exhaust from the expansion chamber.

Further, the efficiency of a steam engine will be significantly reduced if the internal surfaces of the engine along which the steam must pass are relatively cool as compared to the temperature of the steam from the boiler. In this case, substantial heat energy is transferred from the steam to the engine surfaces before the steam has utilized its energy in the expansion chamber. Thus, the usable amount of heat energy of the steam is reduced and condensation takes place which may restrict or interrupt steam circulation. In order to reduce this deletorious effect, it is necessary to keep the internal surfaces of the engine at as high a temperature as possible. In conventional reciprocating steam engines, steam jackets or the like have been utilized to maintain a relatively high temperature of the internal surfaces of the cylinder. In this instance, cylinder walls and heads are made with double walls and the space thus enclosed within them is filled with live steam at boiler pressure and temperature. However, such steam jackets are bulky, expensive to fabricate and may add considerably to the overall weight of the engine.

Unduly high back or exhaust pressure also contributes significantly to the reduction of efficiency in reciprocating steam engines. Clearance volume of the engine cylinders cannot be eliminated entirely as it is impossible to provide steam and exhaust ports without volume. Furthermore, the piston must not strike the cylinder heads. Thus, a certain amount of steam is trapped between the piston and the cylinder head at the point where the piston is closest to the cylinder head and changing direction at the end of its path of travel. In a reciprocating engine, a small amount of back pressure may be desirable as it aids in the change of direction of the piston, thereby cushioning the heavy reciprocating parts. However, steam, when compressed in the clearance space, incurs a rise in temperature due to the work done upon it. When the temperature of the compressed steam exceeds that of the clearance space walls, which were cooled by the exhaust steam, the heat of the compressed steam is transferred to the cooler surfaces, and a thermal loss thereby occurs. In addition, unduly high back pressure acts in opposition to the movement of the piston thereby reducing the speed and power thereof. The steam pressure in the exhaust system also acts against the movement of the piston. The pressure of the expanded steam within the engine cylinder during the exhaust stroke is largly controlled by the pressure existing in the exhaust pipe attached to the cylinders. A gain in horsepower is developed when the exhaust pressure is decreased. It is possible to reduce the exhaust pressure of the engine by increasing the diameter of the exhaust port and conduits therefrom, thereby permitting the exhaust steam to exit the cylinder more easily and more quickly.

In reciprocating steam engines, the steam engine valves and associated gearing which activates the valves control the distribution of steam within the engine cylinder. The steam distribution process includes control of the vents of admission, their point of cutoff, the period of expansion, exhaust, and compression of the exhaust steam at the opposite side of the piston during the working cycle. Both the power developed by the engine and the economy of operation are effected by the valve and valve control mechanisms. Certain valves, together with their gears, have inherent limitations which materially reduce the thermal efficiency of the engines thus equipped. In particular, such valves may prevent a wide range of steam cutoff points because of the physical limitations thereof. Since the cutoff point controls the speed, torque, and efficiency of the engine, this substantially detracts from the overall functioning and versatility of the engine. It is, therefore, advantageous to have valves and the associated gearing capable of being operated through a wide range of infinite cutoff points, thereby enhancing the efficiency and versatility of the engine.

It is, therefore, a prime object of the present invention to provide a spherical rotary steam engine which eliminates the necessity for the continuous opening and closing of valves between the expansion-compression chamber and the intake and exhaust manifolds, respectively, and thus the associated gearing normally required to accomplish this result.

It is another advantage of the present invention to provide a spherical rotary steam engine wherein the interior surfaces of the engine are heated by exhaust steam to reduce thermal loss and steam condensation.

It is a further advantage of the present invention to provide a spherical rotary steam engine wherein the structure of the engine substantially reduces the back or exhaust pressure.

It is still another object of the present invention to provide a spherical rotary steam engine wherein valve means control the steam cutoff point throughout a relatively wide range by means of a simple and reliable mechanism.

It is a still further object of the present invention to provide a spherical rotary steam engine comprising a relatively small number of simple parts which operate in a reliable and efficient fashion.

In accordance with the present invention, the spherical rotary steam engine includes a housing defining a cavity therein. A cylindrical member is movably mounted within the cavity. A drive member is operatively connected to the cylindrical member for driving same. The cylindrical member, the drive member and the interior wall of the cavity define an expansion-compression chamber. Steam intake means and steam exhaust means are respectively provided adjacent the cavity. The cylindrical member has a steam passage therein which, in at least one operative position of the cylindrical member, operatively connects the expansion-compression chamber to the intake means and in at least one other operative position of the cylindrical member, operatively connects the expansion-compression chamber to the exhaust means. An output shaft is rotatably mounted within the housing and operatively connected to the cylindrical member to be driven thereby.

The cavity defined by the housing is preferably spherical in shape and the cylindrical member or drum is rotatably mounted therein. The drive member, having a plate-like configuration, is movably mounted within the cylindrical member and is rotatable about an axis which is different from the axis of rotation of the cylindrical member. Within the drive member is situated an exhaust chamber which is conditionally connected to the expansion-compression chamber by means of an exhaust port through the surface of the drive member and a movable sleeve valve situated on the surface of the drive member which covers and uncovers the exhaust port. This internal exhaust chamber forms a part of a secondary exhaust system designed to reduce back pressure.

The sleeve valve is movable relative to the drive member or plate to open and close the exhaust port. The sleeve valve has a part engagable with the cylindrical member such that the sleeve is moved relative to the drive member as the drive member moves relative to the cylindrical member. Therefore, exhausting of the steam through the exhaust chamber in the drive member is controlled by the relative movement between the cylindrical member and drive member which requires no external gearing for the actuation thereof.

An exhaust conduit extends through the housing into the cavity of the drive member and terminates within the exhaust chamber. The drive member is rotatable about this conduit which defines the axis of rotation thereof. The removal of exhausted steam through the exhaust chamber in the drive member, in addition to reducing back pressure, serves to keep the drive member and other internal parts of the engine at a relatively high temperature thereby reducing the heat loss and condensation of the steam.

The intake and exhaust means preferably take the form of annular intake and exhaust manifolds, respectively, each of which is positioned on a different side of the housing adjacent the cavity. Thus, as the cylindrical member rotates, the steam passage therein first connects the expansion-compression chamber with the intake manifold. The steam in the intake manifold enters the expansion-compression chamber and causes the expansion of the chamber which, in turn, moves the drive member. The movement of the drive member rotates the cylindrical member. As the cylindrical member rotates, the passage is moved to a position adjacent to the exhaust manifold. In this position, the steam passage in the cylindrical member connects the expansion-compression chamber in the working sphere to the exhaust manifold permitting the exhausting of spent steam through the exhaust manifold as the expansion-compression chamber is contracted.

A circular ring valve is situated within the housing interposed between the intake-exhaust passage of the cylindrical member and the expansion-compression chamber of the working sphere and the exhaust and intake manifolds, respectively. By moving the ring valve relative to the housing, the angle of rotation during which the steam passage is connected to the intake manifold and exhaust manifold, respectively, can be varied. In this manner, the steam cutoff point of the engine and, thus, the speed and torque of the engine may be regulated. The movement of the ring valve relative to the housing is preferably accomplished by a simple steam driven motor operatively connected to the throttle to be controlled thereby. Advancing the throttle causes the steam driven motor to move the ring valve and, thus, vary the steam cutoff point of the engine. No continuously opening and closing valve is required to control steam intake.

The closed portion of the ring valve spans an arc of 150° and permits a large range of variation in the steam cutoff point. However, when the opening between the intake manifold and the cylindrical member is at or near its greatest length of arc, thereby permitting the longest period of steam intake before cutoff, the steam passage in the cylindrical member, the drum, and the exhaust manifold (because of the length of the closed portion of the ring valve) will align relatively late in the rotation of the drum. Thus, a large back pressure will be present in the expansion-compression chamber because exhausting of spent steam is not possible at the beginning of the contraction of the expansion-contraction chamber. In order to overcome this difficulty, the alternate exhaust route, through the exhaust chamber within the drive member, the plate, is utilized. The sleeve valve over the exhaust port on the plate will open to permit earlier exhausting of the expansion-compression chamber, thereby reducing back pressure. The exhaust port will remain open until well into that portion of the cycle when the expansion-compression chamber is connected to the exhaust manifold and, thus, alternate routes of exhaust will be opened simultaneously through a portion of the cycle. Thereafter, the exhaust port will close and the remainder of the spent steam will exit through the exhaust manifold.

The basic structure of the spherical rotary steam engine of the present invention is similar, in many respects, to that of a spherical rotary internal combustion engine disclosed in my copending Application Ser. No. 556,707, filed Mar. 10, 1975, entitled ANTI-POLLUTANT SPHERICAL ROTARY ENGINE WITH AUTOMATIC SUPERCHARGER, now U.S. Pat. No. 3,934,559, issued Jan. 27, 1976. The present invention demonstrates many of the advantages of this internal combustion engine as well as many of the advantages of conventional steam engines.

In the present invention, there are no reciprocating valves or associated gearing comparable to that necessary in the conventional reciprocating steam engines. Further, the exhaust chamber in the drive member, the plate, is heated by the exhausted steam and, thus, maintains the temperature of the internal parts of the engine at a relatively high temperature reducing heat loss and condensation. Moreover, alternate exhaust routes reduce back pressure of exhaust steam. The cutoff valve is a simple circular ring valve operated by a steam driven motor. It need not continuously open and close, but is merely moved into the appropriate position in accordance with the setting of the throttle. The engine is manufactured of simple parts, relatively few in number, which are designed to operate efficiently and reliably throughout the life of the engine. It is vibration free because of the inherent balancing of the running parts and can utilize low grade fuels which are burned completely to reduce pollution.

To the accomplishment of the above, and to such other objects as may hereinafter appear, the present invention relates to a spherical rotary steam engine as set forth in the claims and as described in the specification taken together with the accompanying drawings wherein like numerals refer to like parts and in which:

Figure 1:
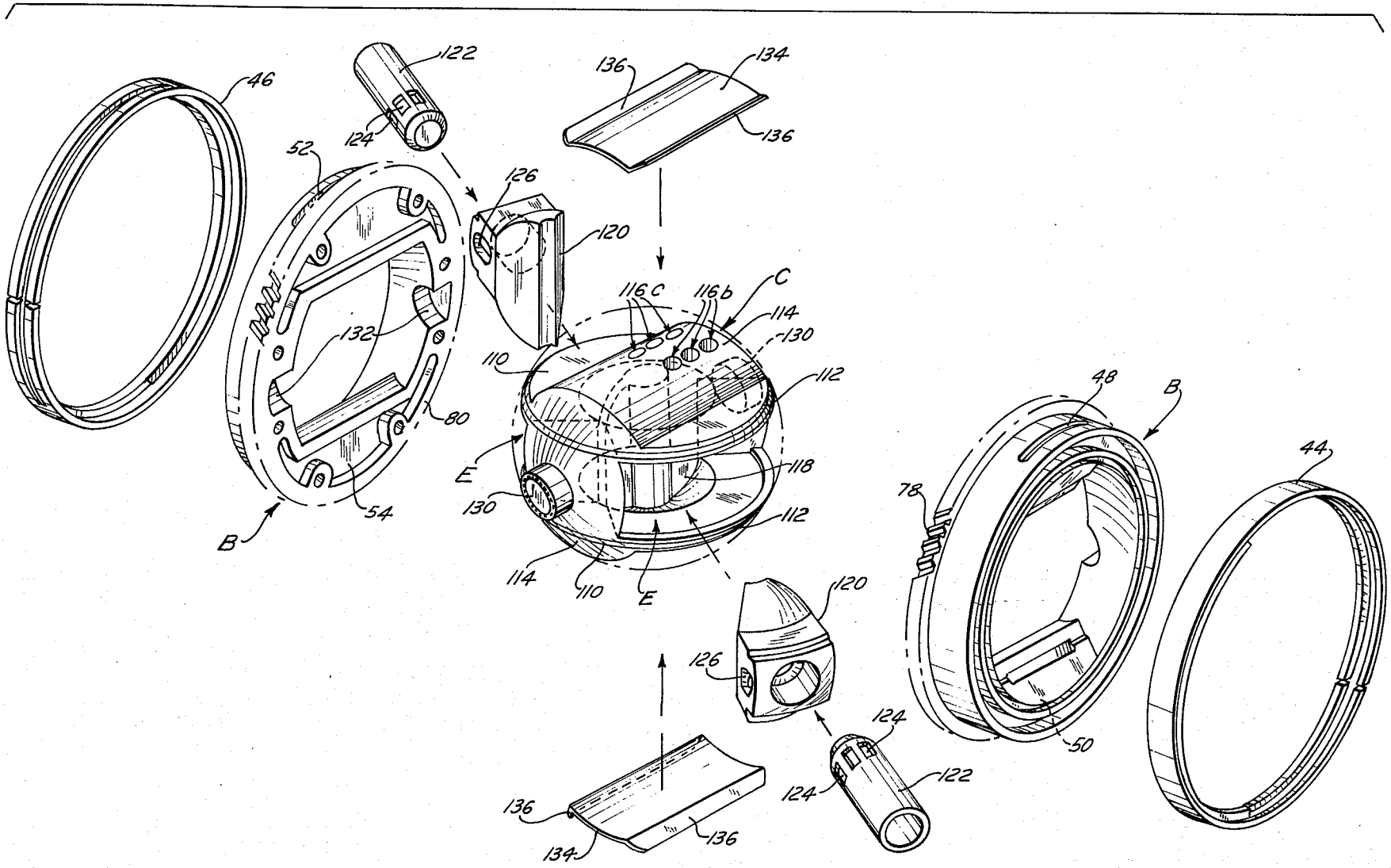
FIG. 1 is an exploded isometric view of a portion of the interior of the spherical rotary steam engine of the present invention consisting of drive member, the plate, and driven member, the drum, together with exhaust tubes and plate cylinder slide valves, etc.

As seen in FIGS. 1–4, the spherical rotary steam engine of the present invention includes a housing, generally designated A, which has an internal spherical cavity in which a cylindrical member, or drum, generally designated B, is rotatably mounted. A drive member or plate, generally designated C, is movably mounted within cylindrical member B so as to rotate the cylindrical member relative to the housing in order to drive an engine shaft, generally designated D, to which cylindrical member B is connected.

Four expansion-compression chambers are defined by the cylindrical member B, drive member C and the interior wall of housing A. Housing A is provided with two annular manifolds, side by side, which encircle the main engine housing. Each manifold is divided into a semi-circular high pressure steam intake manifold and a semi-circular low pressure steam exhaust manifold. Steam inlet and exhaust openings for each of the four expansion-compression chambers are provided in cylindrical member B, the drum, such that as cylindrical member B rotates, each of the expansion-compression chambers is alternately connected to the steam intake and later to the steam exhaust manifold aligned therewith in the housing. A pair of circular ring valves are situated around cylindrical member B, the drum, along the circular path of movement of the intake-exhaust openings therein between the cylindrical member B and the intake and exhaust manifolds in housing A, in order to regulate the relative portions of each rotation of the cylindrical member B during which steam intake and steam exhaust to and from the expansion-compression chamber occurs.

The drive member or plate C has a pair of exhaust chambers E formed in the interior thereof. Each of the exhaust chambers E is conditionally connected to two of the expansion-compression chambers by means of exhaust ports on the exterior cylindrical surface of plate C which are opened and closed by means of the appropriate sleeve valves. The exhaust chambers E within the drive member or plate C are operably connected to the exhaust manifold by a pair of conduits which define the axis of rotation of drive member or plate C.

The expansion-compression chambers work in pairs such that when one pair is expanding, the diametrically opposite pair is contracting. The expansion of the expansion-compression chamber causes the movement of drive member or plate C, which, in turn, causes the rotation of cylindrical member drum B, the rotation of which is transferred to engine shaft D to drive same. Steam for expanding the expansion-compression chamber passes from the steam intake manifold through the ring valve and the intake-exhaust opening in cylindrical drum B such that it enters the expansion-compression chamber wherein its energy is utilized to expand the chamber. When entering steam expands the expansion chamber, it causes the drive member, plate C, to rotate and thereby rotate the cylindrical member drum B to the appropriate position. The exhaust of the spent steam takes place through the intake-exhaust opening in cylindrical member B, the circular ring valve, and the exhaust manifold and/or through the exhaust chamber E in the interior of drive member plate C by way of a conduit, depending upon the position of the ring valve associated with that expansion-compression chamber.

More specifically, housing A is divided into two housing halves 10, 12, each of which has a hemi-spherical cavity therein such that when the halves 10 and 12 of the housing are assembled, the spherical cavity forms the working sphere of the rotary engine. Bolted to the housing A are a paiar of annular housing manifolds, 14, 16, each of which is divided into a semi-circular high pressure steam intake manifold **14*a*, 16*a* and a semi-circular low pressure steam exhaust manifold 14*b* and 16*b*. The semi-circular intake manifold 14*a* is side by side with exhaust manifold 16*b* and intake manifold 16*a* is side by side with exhaust manifold 14*b* such that opposite pairs of expansion-compression chambers can operate in unison. Each of the steam intake manifolds 14*a* and 16*a* is connected at one end thereof to the high pressure output port of a boiler (not shown) and at the other end to an inlet port in the high pressure side of the boiler such that the steam therein can return to the high pressure side of the boiler. In this manner, there is always a continuous flow of high pressure, super heated steam through each of the semi-circular circular intake manifolds 14*a*, 16*a*. The semi-circular low pressure steam exhaust manifolds 14*b*, 16*b* are connected to the low pressure input side of the boiler such that the spent steam returned to the boiler can pass through the boiler and be reheated and then pass on to the high pressure side of the boiler after which it is returned to the intake manifolds 14*a*, 16*a*.**

A plurality of bolts 18 are provided for assembling the main engine housing halves 10, 12. Further, a plurality of bolts 20 are provided for attaching the annular manifolds 14, 16 to the main engine housing A. An oil seal type gasket 22 is provided between housing halves 10, 12.

A high pressure steam intake tube 24*a* is provided to transport high pressure steam from the boiler to manifold 14*a*. In a similar fashion, a high pressure steam intake tube 26*a* supplies high pressure steam to intake manifold 16*a* from the high pressure side of the boiler. A high pressure steam return conduit 28 is connected to manifold 16*b* side by side with manifold 14*a* to return the unused steam therein to the high pressure side of the boiler for reheating. In a similar manner, a high pressure steam outlet return 30 from intake manifold 16*a* is provided to return unused steam to the high pressure side of the boiler for reheating. Spent steam exhaust conduits 24*b*, 26*b* are provided for returning spent steam from manifolds 14*b* and 16*b*, respectively, to the low pressure side of the boiler.

Spacers 32 provided in the housing surrounding the working sphere are tightly packed with asbestos heat insulating material to retain the heat level of the interior surfaces of the working sphere in the housing as high as possible. Also, on the three sides surrounding the annular steam intake and exhaust manifolds, are spaces 34, tightly packed with asbestos heat insulating material to retain the heat level existing on the interior surfaces of these manifolds.

Figure 2:
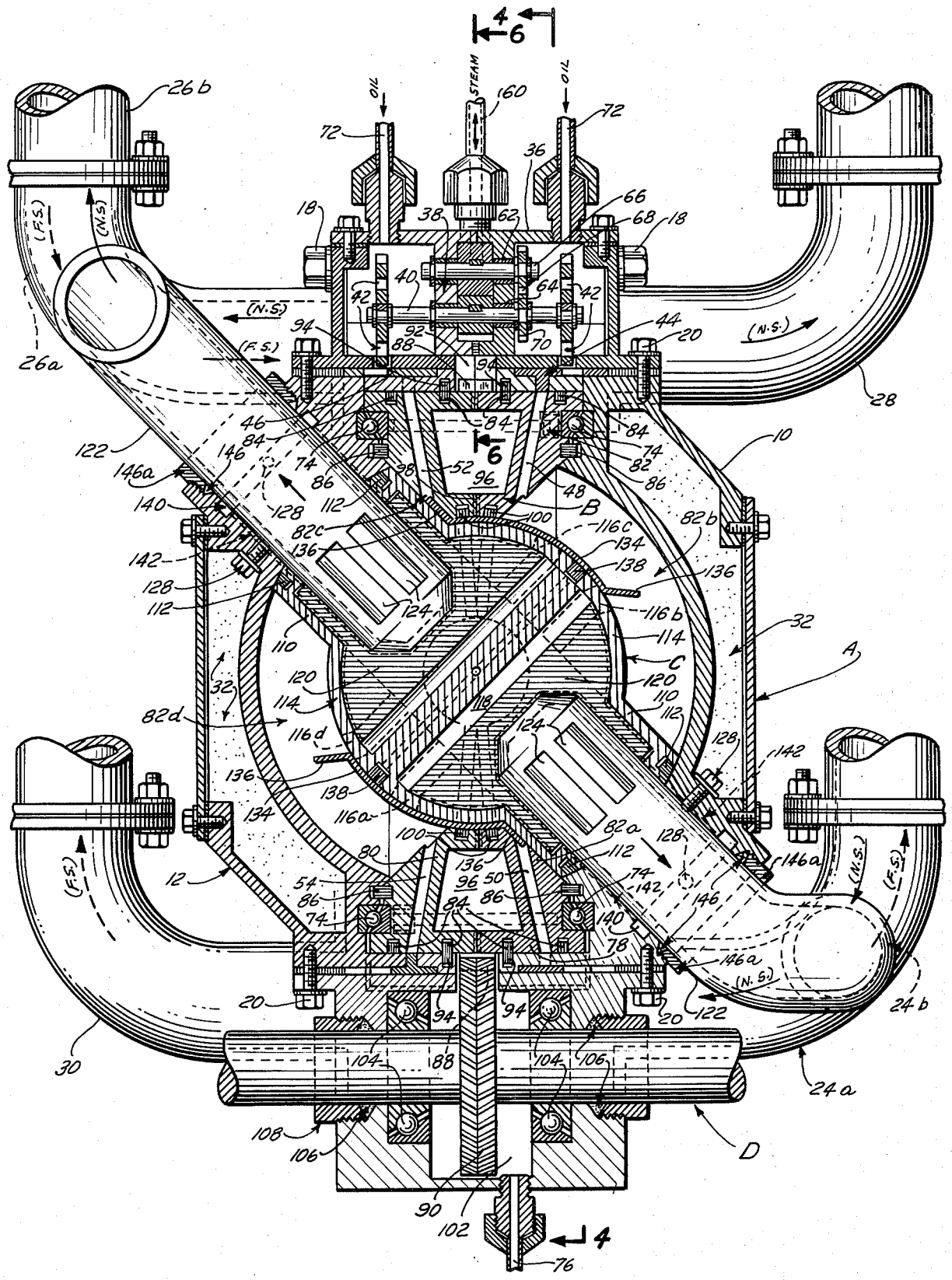
FIG. 2 is a cross-sectional view taken vertically through the interior of the spherical rotary steam engine of the present invention.
Figure 3:
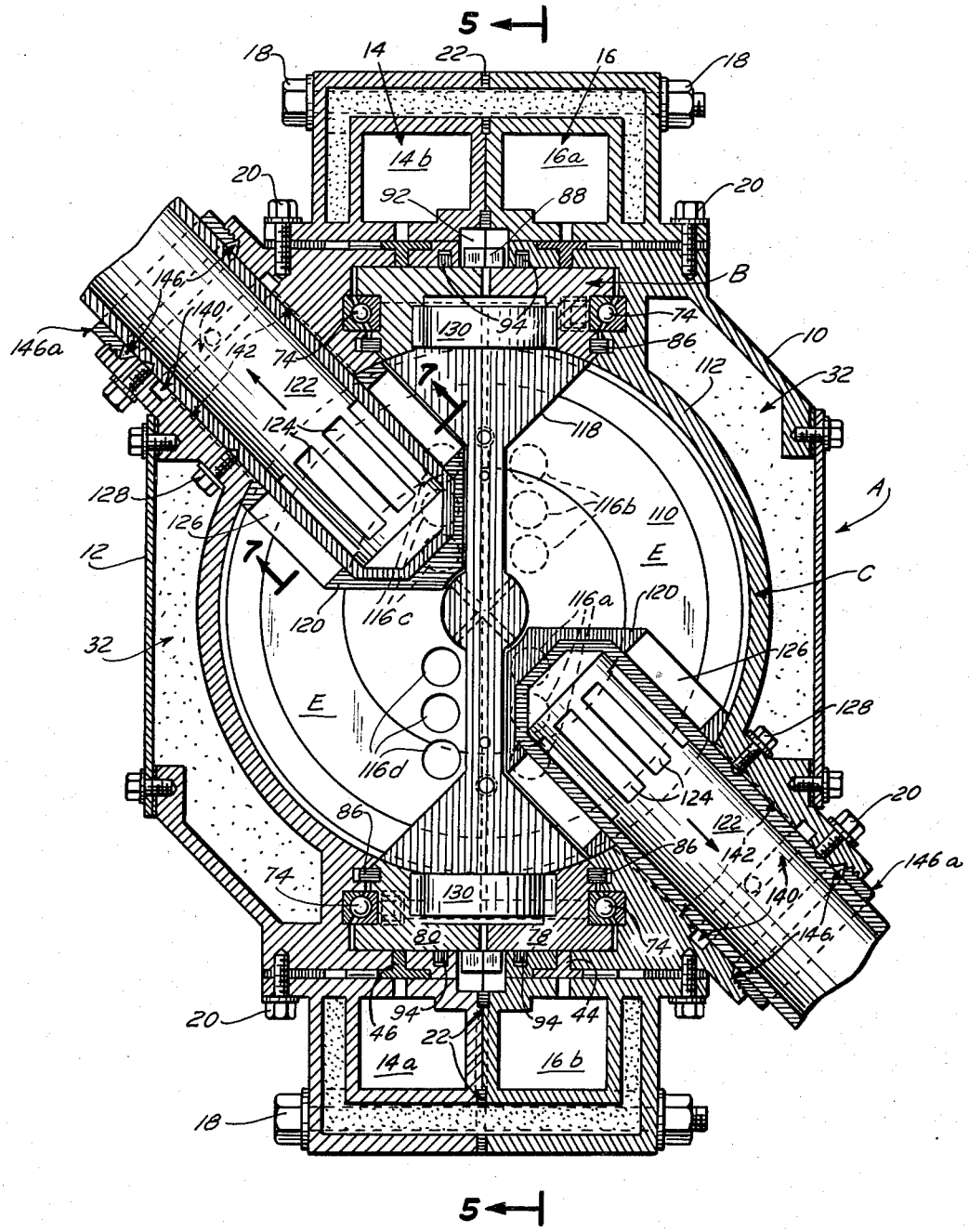
FIG. 3 is a cross-sectional view taken horizontally through the interior of the spherical rotary steam engine of the present invention as seen along line 3—3 of FIG. 5.
Figure 4:
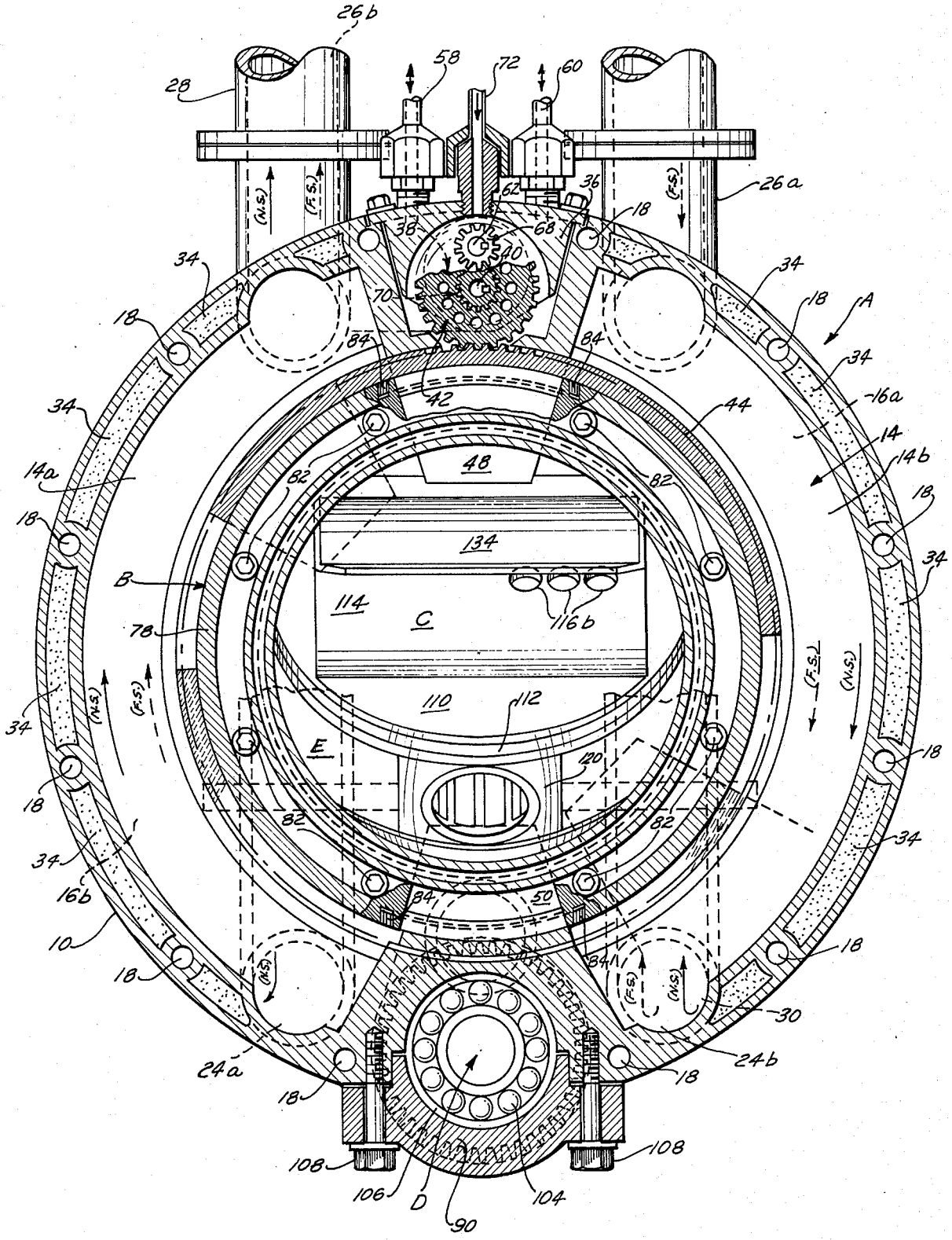
FIG. 4 is a cross-sectional view taken along line 4—4 of FIG. 2.
Figure 5:
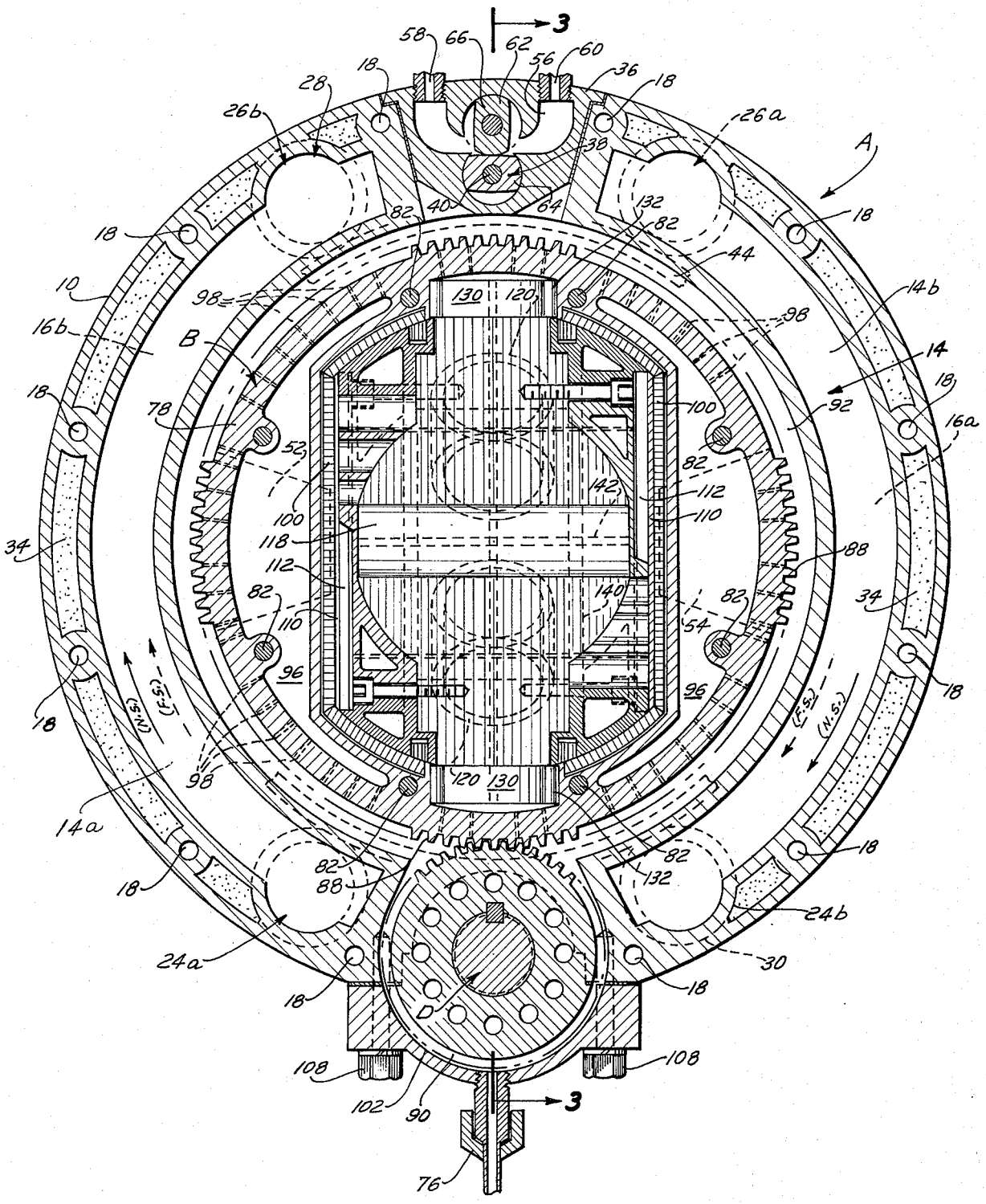
FIG. 5 is a cross-sectional view taken along line 5—5 of FIG. 3.

As seen in FIGS. 2, 4 and 5, the upper portion of the housing has a split housing insert 36 which contains a pump-type steam operated motor 38 connected, by means of an output shaft 40, to a pair of driving gears 42 which are operatively connected to circular ring valves 44, 46 which surround the cylindrical member drum B at a set of points in alignment with the circular path of the intake-exhaust openings 48, 50, and 52, 54, respectively, in cylindrical drum member B. Each of the circular ring valves 44, 46 has a T-shaped cross-section throughout 150° of its circumference and a slit around the other 210°. The circular ring valves are oppositely oriented such that the 210° slit in valve 44 is 180° out of phase with the 210° slit in valve 46. The slit in circular ring valve 44 aligns with intake-exhaust openings 48 and 50, alternatively, as cylindrical member, drum B rotates relative to the housing. In a similar manner, the slit in circular ring valve 46 aligns with intake-exhaust openings 52 and 54, respectively, in cylindrical member B, alternately, as the cylindrical member rotates. The degree of angular rotation of the circular ring valve slit determines the length of the period and the amount of steam entering the expansion-compression chambers. The maximum degree of valve opening is 152°, and divided by 180°, the maximum period of expansion, determines the maximum length of the intake period before cutoff, which is 84 percent of maximum possible expansion. Thus, the position of the circular ring valves relative to the housing controls the speed and torque of the engine. The position of the circular ring valves 44, 46 relative to the housing is controlled by motor 38, which in itself is steam driven by a source of steam which is controlled by the throttle of the vehicle. Thus, when higher speed is to be attained, steam is introduced into the portion 36 of housing A which causes motor 38 to drive gears 42 thereby moving circular ring valves 44 and 46 each having matching gear teeth recesses aligned with gears 42 so that the engine delivers the desired speed and torque to the engine shaft.

Figure 6:
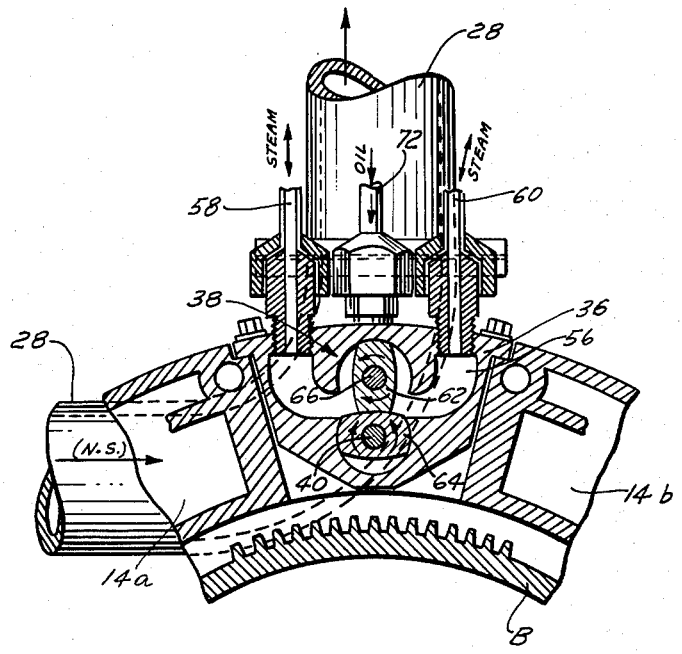
FIG. 6 is a detailed view of the ring valve positioning means as seen along line 6—6 of FIG. 2.

FIG. 6 shows motor 38 in detail. Motor 38 consists of a steam passage 56 connected at different ends to a conduit 58 and a conduit 60. A pair of spaced rotors 62, 64 are in meshing engagement within the passage 56. Rotors 62, 64 are mounted on the shaft 66, 40 which, in turn, are interconnected by means of gears 68, 70 (FIG. 4). This steam driven motor is of the Root type motor and will rotate shaft 40 in one direction or the other, depending upon the direction of steam flow in passage 56. Therefore, if steam flows in through conduit 58 and out conduit 60, the circular ring valves will be rotated in one direction and if steam flows in conduit 60 and out conduit 58, the circular ring valves will be rotated in the opposite direction. Oil inlet conduit 72 is utilized to supply oil to the drum ring gear, circular ring valves, 44, 46 and sliding surfaces between the ring valves and the housing and the drum B as well as to the oil drum roller bearings 74. This oil, after it has flowed through these parts of the engine, exits the housing at oil conduit 76 wherein it is returned to the oil filtering and pumping system to be recirculated.

Cylindrical member, drum B is divided into two halves 78 and 80, respectively, which are bolted together by means of bolts 82 to form the cylindrical member. Inlet-exhaust openings 48 and 50 are present in cylindrical half 78. Likewise, inlet-exhaust openings 52 and 54 are present in cylindrical half 80. The cylindrical drum B bisects the working sphere into approximately two hemispherical sections which are again divided by drive member or plate C to form four separate expansion-compression chambers 82*a*, 82*b*, 82*c*, 82*d*. Each of the expansion-compression chambers 82*a*, 82*b*, 82*c*, 82*d* is a variable volume spherical wedge which expands upon the introduction of high pressure steam thereto in order to remove drive member C and contracts to exhaust the spent steam. The expansion-compression chambers work in diametrically opposite pairs, thus, expansion-compression chambers 82*a* and 82*c* act together and expansion-compression chambers 82*b* and 82*d* act together. Each pair of expansion-compression chambers acts opposite to the other pair such that as one pair is expanding, the other pair is contracting and vice versa.

Oval shaped spring steel seals 84 are recessed in the circular face of the drum around the inlet-exhaust openings 48, 50, 52 and 54. Circular steel expansion rings 86 recessed in the sides of the drum and housing, provide a steam tight sliding fit against the rotating drum. The drum roller bearings 74 are situated to support both radial and axial loads of the drum in the housing.

The outer periphery of the cylindrical member, drum B is provided with a drum ring gear 88, preferably in herringbone gear form, which meshes with a herringbone pinion gear 90 keyed to engine shaft D such that the rotation of cylindrical member drum B rotates engine shaft D. An annular oil circulating space 92 is provided around the drum ring gear to provide lubrication for the ring gear and pinion gear, as well as the sliding surfaces of the drum B, sleeve ring valves and concave surface of the housing A. Spring steel seal rings 94 are recessed in housing A in order to seal the annular oil circulating space 92 around the drum gear 88.

Cylindrical member B is provided with an interior space 96 containing oil which lubricates the concave edges of drum B where some slides on the convex faces of the plate sleeve valves 134. A plurality of radial oil holes 98 are provided between the drum ring gear teeth to supply oil from the annular oil space to the interior spaces of the drum B. Spring steel expansion strip seals 100 are recessed in the concave edges of the cylindrical member B providing a steam tight sliding fit against the convex faces of the plate sleeve valves 134.

An oil well 102 connected to oil outlet conduit 76 surrounds engine shaft D and gear 90 connected thereto. Engine shaft D is rotatably mounted in housing A by means of ball bearings 104 supporting radial and axial loads which are lubricated by the oil in well 102 by means of oil grooves. The oil in well 102 also lubricates the drum ball bearings 76 by means of the appropriate oil carrying conduits. Engine shaft D is provided with engine shaft oil seal packing rings 106 and a pair of threaded pressure adjusting nuts 108 for the oil seal packing rings 106.

The drive member or plate C consists of two outer circular discs 110, each of which has a circular spring steel expansion ring 112 providing a steam tight sliding fit against the surface of the working sphere. On the exterior surface of each of the circular discs 110 is provided a cylindrical projection 114, each of which has two sets of three exhaust ports **116*a*, 116*b*, 116*c*, and 116*d* connecting the interior of the plate assembly C to the expansion-compression chambers. Thus, exhaust ports 116*a* connect expansion-compression chamber 82*a* to one of the exhaust chambers E of drive member C. In a similar fashion, exhaust ports 116*b*, 116*c* and 116*d* connect expansion-compression chambers 82*b*, 82*c* and 82*d*,** respectively, to the exhaust chambers E of drive member C.

Between plates 110 in the interior of drive member C is a plate center dividing partition 118 situated perpendicular to discs 110. Partition 118 serves to divide the interior of drive member C into two separate exhaust chambers E, one of which serves expansion-compression chambers **82*a* and 82*b* through exhaust ports 116*a* and 116*b* and the other of which serves expansion-compression chambers 82*c* and 82*d* through exhaust ports 116*c* and 116*d*, respectively. Within each of the exhaust chambers E is a wedge shaped plate exhaust valve 120 which is slidable within the exhaust chamber E between plates 110, and each plate valve 120 has a cylindrical recess into which an exhaust conduit 122 extends. The plate valves 120 rotate on the ends of the exhaust conduits 122 which are connected to exhaust conduits 24*b* and 26*b*,** respectively, to return spent steam to the boiler.

Figure 7:
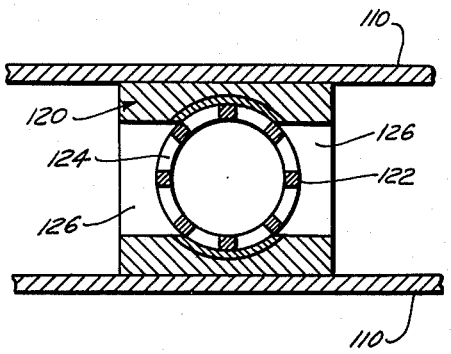
FIG. 7 is a cross-sectional view taken along line 7—7 of FIG. 3.

As is best illustrated in FIG. 7, exhaust conduit 122 is provided with a plurality of peripheral openings 124 which align with the openings 126 in the side of the plate exhaust valves 120 such that in any rotational position of drive member C, spent steam may exit the exhaust chambers E through the plate exhaust valves 120 and into the plate exhaust conduit. Exhaust conduits 122 are held stationery in housing A by means of set screws 128 such that the plate exhaust valves 120 and the plate assembly C rotate about an axis defined by exhaust tubes 122.

The entire plate assembly is movably mounted in cylindrical member drum B by means of a pair of trunions 130, each of which is disposed on the outer portion of one of the opposite sides of plate partition member 118. Trunions 130 are rotatably received within cylindrical recesses 132 formed in cylindrical member drum B when halves 78 and 80 thereof are assembled. Drive member plate C is thus movable in an oscillatory motion relative to cylindrical member, drum B as is explained in detail below.

Covering each of the cylindrical projections 114 on cylindrical member plate C is a plate sleeve valve 134 which has an arcuate central portion with a radius of curvature substantially equal to the radius of curvature of the cylindrical portion 114 and a pair of outwardly extending bent egdes 136. Bent edges 136 abut against the splayed sides of cylindrical member, drum B such that the osillatory movement of drive member plate C relative to cylindrical member, drum B causes the plate sleeve valves 134 to slide on the cylindrical projections 114 in order to uncover or cover exhaust ports **116*a*, 116*b*, 116*c* and 116*d* on the cylindrical projections 114. Thus, plate valve sleeves 134 serve to conditionally connect the appropriate expansion-compression chamber 82 with the exhaust chamber E within drive member, plate C at the appropriate rotational position of cylindrical member, drum B, to permit exhaust of expansion-compression chambers 82.**

The outer surfaces of the plate's cylindrical projections 114 are provided with recessed spring steel expansion strip seals 138 which are centered on the cylindrical projections over which the convex surfaces of the plate sleeve valves 134 slide. The housing is provided with oil wells 140 surrounding the periphery of the plate exhaust tubes 122 and oil grooves 142 which lead from oil wells 140 to the interior sliding surfaces of the plate assembly. Further, oil seal packing rings 146 are provided around the exhaust tubes with threaded pressure adjusting nuts **146*a*.**

In operation, high pressure super-heated steam from the high heat section of the boiler is piped via conduits **24*a* and 26*a* to the semi-circular intake manifolds 14*a* and 16*a*, respectively, where part of the super-heated steam passes through the openings of the circular ring valves 44, 46 into the inlet-outlet slits 48, 50, 52, 54 to the appropriate expansion-compression chambers 82** within the working sphere. The expanding steam entering the expansion-compression chambers presses on two diametrically opposite faces of the driving plate C, thereby causing the driving member, plate C to drive the driven cylindrical member, drum B which, in turn, rotates engine shaft D.

The excess high pressure steam continues to flow through the intake manifolds **14*a* and 14*b* and passes through the return conduits 24*b* and 26*b*, respectively, to the high heat section of the boiler for reheating and thereafter flows back via intake conduits 24*a* and 26*a*, respectively, to the intake manifolds 14*a* and 14*b*.** Thus, high pressure super-heated steam flows in a continuous loop, without intermittent stops caused by the closing of inlet valves, etc. which is characteristic of reciprocating steam engines. Part of this super-heated steam forces its way through the appropriate inlet openings into the expansion-compression chambers so as to rotate the drive member.

The circular ring valves 44, 46 on the periphery of the cylindrical member drum B separate the inlet-outlet slits of the four expansion-compression chambers from the intake manifolds **14*a*, 16*a* and the openings of these circular ring valves may be varied by the degree of rotation of the valves with respect to the housing. This rotation is achieved by means of a small steam operated motor 38** which is connected to the throttle of the vehicle. The position of the valve openings depend upon the speed desired and upon the load on the engine. Thus, the high pressure steam is continuously passing by the inlet-outlet slits of the expansion-compression chambers and the amount of steam forcefully entering the expansion chamber depends upon the length of the arc of the valve openings before steam cutoff.

It should be understood that these circular valves 44 and 46 do not move or rotate continuously to allow steam entry and cutoff during each revolution. Circular ring valves 44 and 46 are merely rotated to the desired position with respect to the housing and remain in this position. When the steam cutoff point is varied, the circular ring valves are moved to a different position in accordance with the desired steam cutoff. Thus, the operation of circular ring valves 44, 46 should be distinguished from the inlet valves in conventional reciprocating steam engines, which must be opened and closed during each engine cycle and, thus, the inlet and exhaust valves must be in continuous motion to allow steam entry and exhaust from the cylinders.

In the engine of the present invention, the exhaust of spent steam occurs automatically without valves, by means of one or two exhaust routes, namely, through exhaust manifolds **14*b* and 16*b* and/or through plate exhaust ports 116, through exhaust chambers E within the plate, and through plate exhaust conduits 122.**

Circular ring valves have openings therein which cover a 210° circular arc. When the valves are set for a steam cutoff at 30°, after the cylindrical member, drum B passes the 135° rotational position, the plate exhaust ports 116 become uncovered by the movement of the plate sleeve valves 134 and the spent steam begins to exhaust through the exhaust tubes 122 and continues to exhaust in this manner until the cylindrical member, drum B reaches the 180° position. From the 180° to the 270° position, spent steam exhausts through both routes, namely, the plate exhaust tubes 112 and the semi-circular exhaust manifold **14*b* and 16*b*. After 270°, exhaust takes place only through exhaust manifold. The plate exhaust tubes 122 and the semi-circular exhaust manifold conduits 24*b* and 26*b*, respectively, are connected together outside of the engine housing and then piped to the low heat section of the boiler for reheating. After the spent steam is brought up to the proper steam pressure and temperature, it flows to the high heat section of the boiler and from there to the intake manifolds. Between 180° and 360°, the expansion-compression chambers 82 exhaust through the exhaust manifolds. From the 270° to the 360° position, the plate exhaust ports 116 are covered and exhaust continues through the exhaust manifolds 14*b*** and 16*b* only.

When the valve opening is set at 118°, the maximum cutoff point, the exhaust through the plate alone starts at 135° position and continues through to the 251° position. At 251°, the slit in the circular ring valve aligns with the exhaust manifold and after the 251° position and up to the 270° position, exhaust takes place through both the plate exhaust tubes and the exhaust manifold. At the 270° position, the plate exhaust transfer ports become covered by the sleeve valves and exhaust thereafter up to 360° position is through the exhaust manifold only.

Because of the arc length of the closed portion of the valves, for purposes of illustration selected at 150°, the valves when set at maximum cutoff do not permit exhaust through the exhaust manifolds to start until the 251° position. It is, therefore, necessary to utilize the plate exhaust chambers E for exhaust, so that exhaust can be continuous during contraction of the expansion-compression chambers, namely, from the 180° to the 360° position, without interruption, in order to eliminate back pressure buildup.

It should also be noted that another very important result of the exhausting of high temperature steam through drive member plate C is that this procedure keeps the temperature of the internal metal surfaces of the spherical wedge as high as possible so that the surfaces will not have a chilling effect on the high temperture incoming steam, which affect would normally absorb some of the steam energy thereby lowering the pressure before the steam begins to expand the expansion-compression chambers.

In convention reciprocating steam engines, the cylinders are often surrounded with a steam chest, into which high temperature and high pressure steam enters and from which the steam is allowed to pass through the inlet valves into the cylinders, thereby preventing the chilling effect of the cool cylinder walls which would cause a considerable drop in the efficiency of the engine. In order to eliminate this necessity for a bulky steam chest, spaces are provided in the housing of the rotary spherical steam engine of the present invention into which asbestos heat insulating material is packed such that the working sphere is surrounded by insulation.

FIGS. 8–15 are schematic representations of the expansion and contraction of the expansion-compression chambers 82. In each of these drawings, the drive member, plate C is viewed as it would be seen from a vantage point rotating along with cylindrical member, drum B. As indicated before, the expansion-compression chambers 82 expand and contract in pairs. Thus, while chambers **82*a* and 82*c* are expanding, chambers 82*b* and 82*d*** are contracting and vice versa. This being the case, one pair of expansion-compression chambers is expanding and the other pair of expansion-compression chambers is contracting during each 180° rotation of cylindrical drum B. Therefore, by observing both pairs of chambers throughout a 180° rotation of the cylindrical drum B, a complete expansion and contraction cycle can be seen.

Figure 8:
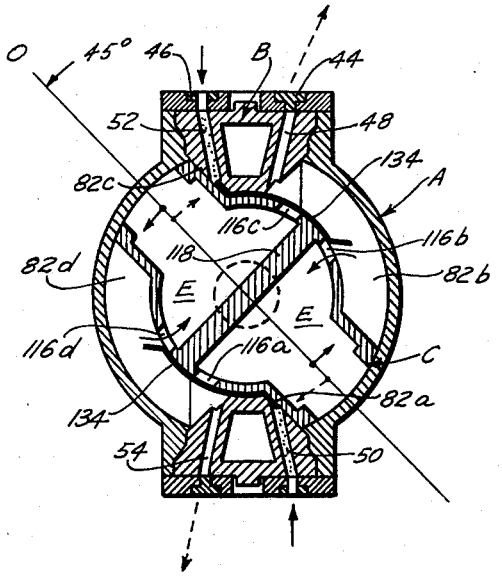
FIGS. 8–15 are semi-schematic diagrams showing the sequence of operation of the spherical rotary steam engine of the present invention.

FIGS. 8–15 illustrate the variation in volume of the expansion and contraction chambers throughout a cycle wherein the steam cutoff occurs at 30°. At the initial position of cylindrical drum B taken arbitrarily to be 0°, as illustrated in FIG. 8, the slit in ring valves 44 and 46 are aligned with intake-exhaust openings 50 and 52, respectively, such that steam enters expansion-compression chambers **82*a* and 82*c*, respectively, from intake manifolds 14*a* and 16*a*, respectively. In this position, sleeve valves 134 cover exhaust ports 116*a* and 116*c*, respectively, such that no exhaust is possible from the expansion-compression chambers 82*a* and 82*c***.

Figure 9:
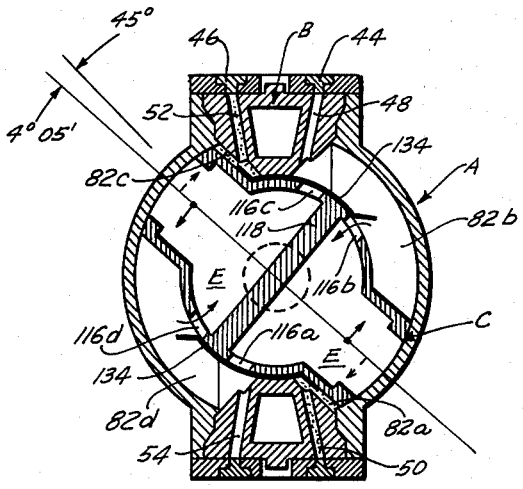

In the 30° position of rotation of cylindrical drum B, as shown in FIG. 9, the steam cutoff occurs and the steam which has entered expansion-compression chambers **82*a* and 82*c* has caused these chambers to expand such that drive plate C is rotated to an angle of 4°-05′ with respect to its original position. At this point in the rotation of cylindrical drum B, intake-exhaust openings 50 and 52 have just been closed because the slits in circular ring valves 44 and 46 no longer align with these openings. Sleeve valves 134 continue to cover ports** 116*a* and **116*c* so that no exhaust is yet possible from chambers 82*a* and 82*c***.

Figure 10:
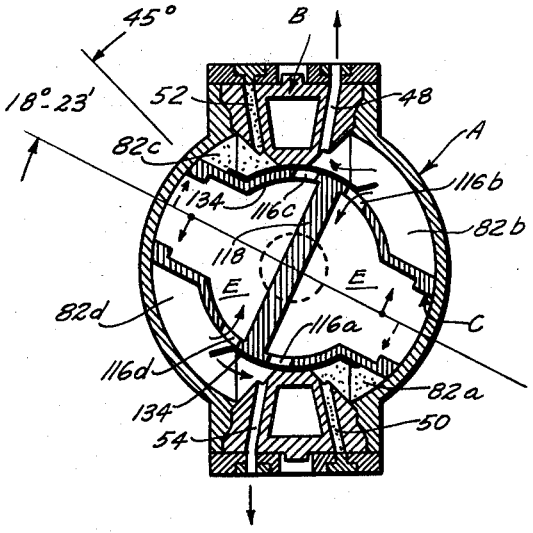

In the 60° position of rotation, as shown in FIG. 10, drive plate C has moved 18°-23′ from its original position by the expansion of the steam in expansion-compression chambers 82*a* and 82*c*. Valve sleeves 134 continue to cover the plate exhaust ports 116*a* and 116*c* and no exhaust is possible from chambers 82*a* and 82*c*.

Figure 11:
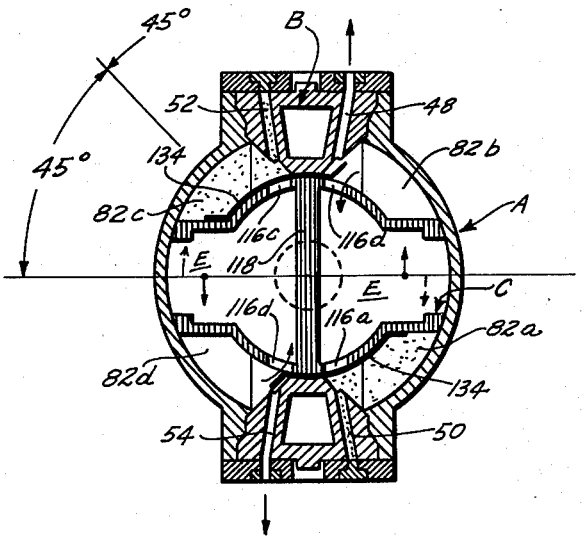

In the 90° position of rotation of cylindrical drum B, as shown in FIG. 11, the expansion of the steam in expansion-compression chambers 82*a* and 82*c* has cause drive plate C to move 45° from its original position. Sleeve valves 134 continue to cover plate exhaust ports and no exhaust is taking place from chambers 82*a* and 82*c*.

Figure 12:
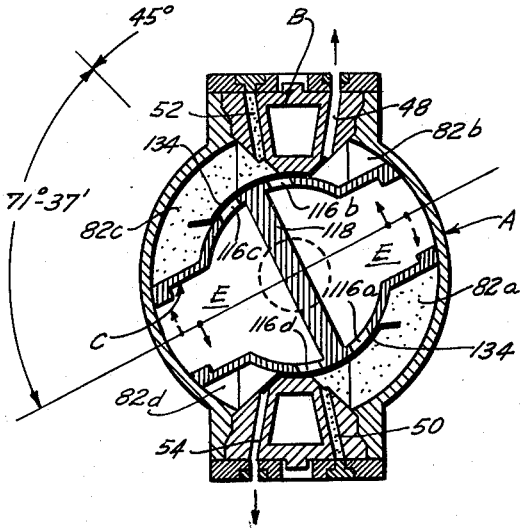

In the 120° position of rotation, as illustrated in FIG. 12, the expanding steam within expansion-compression chambers 82*a* and 82*c* has moved drive plate C an angular distance of 71°-37′ from its original position. Sleeve valves 134 continue to cover ports 116*a* and 116*b*. However, in this position it should be noted that the extended edges 136 of sleeve valves 134 adjacent to chambers 82*b* and 82*d* have now been engaged by the splayed sides of cylindrical drum B and, thus, further rotation of drive plate C with respect to cylindrical drum B will cause the sleeve valves 134 to slide relative to the cylindrical portion of drive plate C and, thus, ultimately uncover ports 116*a* and 116*c*.

It should be noted that the sleeve valves 134 can only be in one of two positions relative to the plate and drum. The pressure of expanding steam in chambers 82*a* and 82*c* hold the extended edge of the sleeve valves 134 hard against the flat face of the plate until the time when the opposite extended edge comes up against the splayed side of the drum. Until this point is reached, sleeve valves 134 remain stationary relative to the cylindrical projection of the plate and together they rotate in the same direction.

Figure 13:
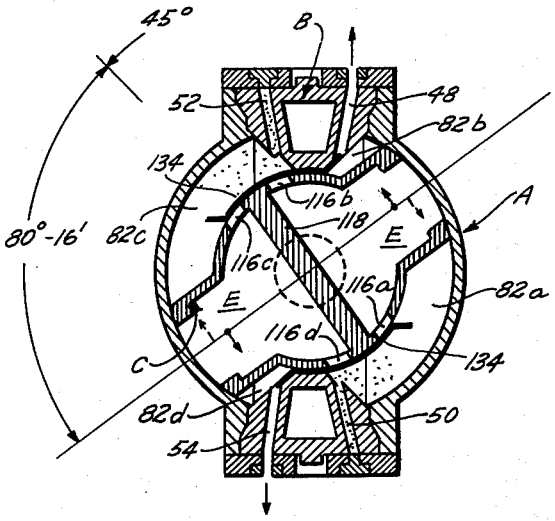

In the 135° position of rotation of cylindrical drum B, as shown in FIG. 13, the expanding steam in expansion-compression chambers 82*b* and 82*c* has moved drive plate C to a position 80°-16′ from its original position. At this point, the sliding of sleeve valves 134 with respect to drive plate C has caused the valve to being uncovering ports 116*a* and 116*c* such that the spent steam from expansion-compression chambers 82*a* and 82*c* will begin to pass through plate exhaust ports 116*a* and 116*c* into the exhaust chambers E in the interior of drive plate C and, in turn, into the exhaust tubes.

Figure 14:
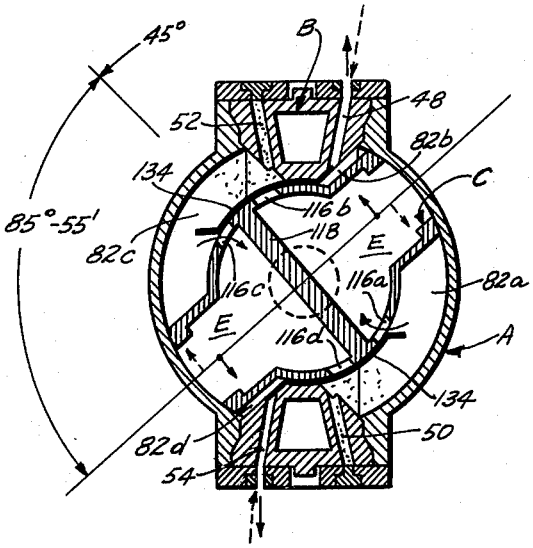

In the 150° position of rotation of cylindrical drum B, as shown in FIG. 14, the expansion of steam within expansion-compression chambers 82*a* and 82*c* has moved drive plate C to a rotational position 85°-55′ from its original position. In addition, the sliding of the sleeve valves 134 relative to the drive plate C has now fully opened plate ports 116*a* and 116*c* such that spent steam is being exhausted through the exhaust chambers E in the interior of drive plate C and exhaust tubes.

In the 180° position of rotation of cylindrical drum B, expansion-compression chambers 82*a* and 82*c* are fully expanded and spend steam is still flowing through plate exhaust ports 116*a* and 116*c* and being exhausted through the chambers E in the interior of the plate. In addition, in the 180° position (which is equivalent to the initial position for the other two expansion-compression chambers 82*b* and 82*d*) the other pair of expanion-compression chambers 82*b* and 82*d* begins receiving high pressure steam and will receive the high pressure steam for an angular rotation of 30°, until the 210° position, wherein the circular ring valves will cut off the supply of steam.

Referring again to FIG. 8, the contraction part of the cycle which expansion-compression chambers 82*a* and 82*c* will go through after the 180° position of rotation is reached can be illustrated by considering what is happening in expansion-compression chamber 82*b* and 82*d* between 0° and 180° positions. At the 0° position, expansion-compression chambers 82*b* and 82*d* are at their maximum volume and plate exhaust ports 116*b* and 116*d* are open. The intake-exhaust openings 48 and 54 are just being uncovered by ring valves 44 and 46, respectively, such that exhaust can now take place through the exhaust manifolds.

As seen in FIG. 9, the expansion of steam in expansion-compression chambers 82*a* and 82*c* has caused drive plate C to rotate 4°-05′ from the position of zero expansion. Sleeve valves 134 have uncovered plate exhaust ports 116*b* and 116*d* and, therefore, exhaust is taking place through the exhaust chambers E in drive plate C. In addition, the slit in circular ring valves 44 and 46 is now in alignment with intake-exhaust openings 48 and 54, respectively, such that exhaust is taking place as well through exhaust manifolds 14*b* and 16*b*, respectively.

As seen in FIG. 10, plate C has moved an angle of 18°-23′ from its original position and exhaust continues to take place through both drive plate C exhaust tubes and the exhaust manifolds.

As seen in FIG. 11, plate C has moved 45° from the original position and exhaust continues to take place through drive plate C and through the exhaust manifolds.

As seen in FIG. 12, the contraction of expansion-compression chambers 82*b* and 82*d* has continued until the drive plate C has reached a rotational position 71°-37′ from its original position. In this position, sleeve valves 134 have covered plate exhaust ports 116*b* and 116*d* thereby preventing any further exhausting of spent steam from expansion-compression chambers 82*b* and 8*d* through drive plate C. However, the exhausting of spent steam continues through exhaust manifold. Expansion-compression chambers 82*b* and 82*d* continue to contract between the 135° and 150° positions, as shown in FIGS. 13 and 14, respectively, valve sleeves 134 continue to cover plate portholes 116*b* and 116*d* and exhaust takes place exclusively through the exhaust manifolds.

Figure 15:
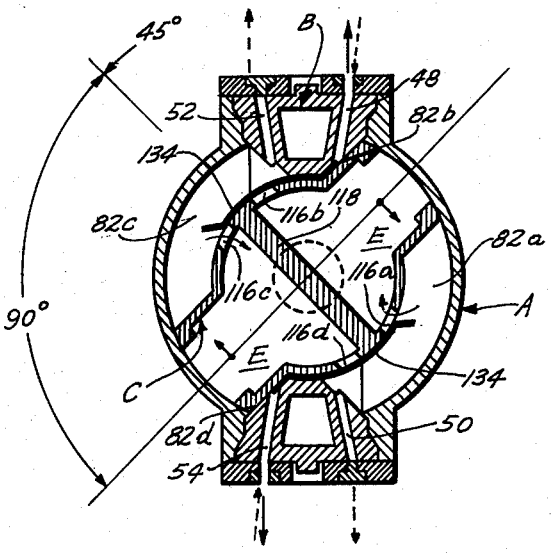

In the 180° position, as shown in FIG. 15, expansion-compression chambers 82*b* and 82*d* are fully contracted, exhaust is no longer taking place but fresh high pressure steam is beginning to flow into intake-exhaust openings 48 and 54 which are now aligned with the open slits in ring valves 44 and 46, respectively, and expansion-compression chambers 82*b* and 82*d* will begin to expand thus repeating the cycle of chambers 82*a* and 82*b* in reverse from 180° position to the 360° position.

It can, therefore, be seen that the spherical rotary steam engine of the present invention eliminates the necessity for the continuous opening and closing of valves with operation of its associated gearing between the expansion-compression chambers and the intake and exhaust manifolds, respectively, as required in conventional reciprocating steam engines. In addition, the interior surfaces of the engine are heated by exhaust steam to reduce the thermal loss and steam condensation and increase the efficiency of the engine. The engine substantially reduces back and exhaust pressures and utilizes a valve means to control the steam cutoff point throughout a relatively large range be means of a simple and reliable mechanism. Further, the spherical rotary steam engine of the present invention is composed of a relatively small number of simple parts which operate in a reliable and efficient fashion to produce an engine which is balanced to function vibration-free and which can be maintained or repaired relatively easily and inexpensively.

While only a single embodiment of the present invention has been disclosed herein for purposes of illustration, it is obvious that many variations and modifications can be made thereto. It is intended to cover all of these variations and modifications which fall within the scope of the present invention as set forth in the following claims.

I claim:

1. A steam engine comprising a housing defining a cavity therein, a cylindrical member movably mounted within said cavity, a drive member operatively connected to said cylindrical member for driving same, said cylindrical member, and drive member and the wall of said cavity defining an expansion-compression chamber, steam intake means adjacent said cavity, steam exhaust means adjacent said cavity, said cylindrical member having a steam passage therein which, in at least one operative position of said cylindrical member, operatively connects said chamber to said exhaust means, an exhaust chamber situated within said drive member, an exhaust conduit extending into said exhaust chamber, said conduit being operatively connected to said exhaust means, means operatively connecting said expansion-compression chaamber to said exhaust chamber, and an output shaft rotatably mounted within said housing and operably connected to said cylindrical member to be driven thereby.

2. The steam engine of claim 1 wherein said drive member rotates about said conduit.

3. The steam engine of claim 1 wherein said connecting means comprises an exhaust port in said drive member between said exhaust chamber and said expansion-compression chamber and a valve sleeve movable relative to said drive member to open and close said exhaust port.

4. The steam engine of claim 3 wherein said valve sleeve has a part engagable with said cylindrical member such that said sleeve is moved relative to said drive member as said drive member moves relative to said cylindrical member.

5. The steam engine of claim 3 wherein said valve sleeve is positioned to open said exhaust port before said cylindrical member is in said other operative position.

6. The steam engine of claim 3 wherein said sleeve is positioned to open said exhaust port during at least a portion of the time when said cylindrical member is in said other operative position.

7. The steam engine of claim 1 wherein said cylindrical member is rotatably mounted in said cavity.

8. The steam engine of claim 7 wherein the axis of rotation of said cylindrical member and the axis of rotation of said engine shaft are parallel.

9. The steam engine of claim 7 further comprising means for mounting said drive member for oscillatory motion within said cylindrical member.

10. The steam engine of claim 9 wherein said drive member rotates about said conduit.

11. The steam engine of claim 10 wherein the axis of rotation of said drive member is different than the axis of rotation of said cylindrical member.

12. A steam engine comprising a housing defining a cavity therein, a cylindrical member movably mounted within said cavity, a drive member operably connected to said cylindrical member for driving same, said cylindrical member, said drive member and the wall of said cavity defining an expansion-compression chamber, steam intake means adjacent said cavity, steam exhaust means adjacent said cavity, said cylindrical member having a steam passage therein which in at least one operative position of said cylindrical member operably connects said chamber to said exhaust means, valve means interposed between said intake means of said cavity and movable relative to said cavity to vary the duration of said one position of said cylindrical member, means for moving said valve means, an output shaft rotatably mounted within said housing and operatively connected to said cylindrical member to be driven thereby.

13. The steam engine of claim 12 wherein said valve means is also interposed between said exhaust means and said cavity and movable relative to said cavity to vary the comparative durations of said one position and said other position of said cylindrical member.

14. The steam engine of claim 12 further comprising an exhaust chamber situated within said drive member, an exhaust conduit extending into said exhaust chamber, said conduit being operatively connected to said exhaust chamber and said exhaust means and means operatively connecting said expansion chamber to said exhaust chamber.

15. The steam engine of claim 12 wherein said intake means comprises an intake manifold and said exhaust means comprises an exhaust manifold.

16. The steam engine of claim 12 wherein said valve means moving means is steam driven and further comprising a throttle, said moving means being controlled by said throttle.

17. The steam engine of claim 12 wherein said valve means is arcuate.

18. A steam engine comprising a housing defining a cavity, a cylindrical member movably mounted within said cavity, a drive member movably mounted to said cylindrical member for driving same, said cylindrical member, said drive member and said cavity wall defining an expansion-compression chamber, steam intake means adjacent said cavity, an exhaust chamber within said drive member, said cylindrical member having a steam passage therein, which, in at least one operative position of said cylinder, operatively connects said intake means and said expansion-compression chamber, means responsive to the movement of said drive member relative to said cylindrical member to conditionally connect said exhaust chamber and said expansion-compression chamber, an output shaft rotatably mounted within said housing and operatively connected to said cylindrical member to be driven by same.

19. The steam engine of claim 18 further comprising valve means interposed between said intake means and said cavity and movable relative to said cavity to vary the duration of said one position of said cylindrical member, and means for moving said valve means.

20. The steam engine of claim 19 further comprising an exhaust manifold, said passage aligning with said exhaust manifold in an other position and wherein said valve means is interposed between said expansion-compression chamber and said cavity of movable relative to said cavity to vary the comparative durations of said one position and said other position of said cylindrical member.

21. The steam engine of claim 19 wherein said valve means moving means is steam driven and further comprising a throttle, said moving means being controlled by said throttle.

22. The steam engine of claim 21 wherein said valve means is arcuate.

23. The engine of claim 18 further comprising an exhaust conduit extending into said cavity and operatively connected to said exhaust chamber.

24. The steam engine of claim 23 wherein said drive member rotates about said conduit.

25. The steam engine of claim 18 wherein said connecting means comprises an exhaust port in said drive member connecting said exhaust chamber and said expansion-compression chamber and a valve sleeve movable relative to said drive member to open and close said exhaust port.

26. The steam engine of claim 25 wherein said valve sleeve has a part engagable with said cylindrical member such that said sleeve is moved relative to said drive member as said drive member moves relative to said cylindrical member.

27. The engine of claim 26 wherein said sleeve is positioned to open said exhaust port after said cylindrical member has moved from said one operative position.

28. The steam engine of claim 18 wherein said drive member is rotatably mounted within said cylindrical member.

29. The steam engine of claim 18 wherein said cylindrical member is rotatably mounted in said cavity.

30. The steam engine of claim 29 wherein said exhaust chamber is situated within said drive member and further comprising an exhaust conduit extending into said cavity and operatively connected to said exhaust chamber and means operatively connecting said expansion chamber to said exhaust chamber.

31. The steam engine of claim 30 wherein said drive member rotates about said conduit.

32. The steam engine of claim 31 wherein the axis of rotation of said drive member is different than the axis of rotation of said cylindrical member.

33. The steam engine of claim 29 wherein the axis of rotation of said cylindrical member and the axis of rotation of said engine shaft are parallel.

34. A steam engine comprising a housing defining a cavity therein, a driven member rotatably mounted in said cavity, a drive member operatively connected to said driven member to drive same, said driven member, said drive member and said cavity wall defining an expansion-compression chamber, means for generating steam, steam intake means situated at a first opening along said cavity, means operably connecting said steam generating means and said steam intake means, steam exhaust means situated at a second opening along said cavity, said driven member having a steam passage therethrough which, when adjacent said first opening, connects said intake means with said chamber and, when adjacent said second opening, connects said exhaust means with said chamber, valve means interposed between said cavity wall and said intake and exhaust means at said first and second openings, respectively, means for moving said valve means relative to said housing to vary the size of said first and second openings, respectively, and an output shaft rotatably mounted within said housing and operably connected to said driven member to be driven thereby.

35. The steam engine of claim 34 wherein said valve means moving means comprises a steam driven motor operatively connected to said valve means to move same.

36. A steam engine comprising a housing defining a cavity therein, a driven member rotatably mounted in said cavity, a drive member operatively connected to said driven member to drive same, said driven member, said drive member and said cavity wall defining an expansion-compression chamber, steam intake means situated at a first opening along said cavity, steam exhaust means situated at a second opening along said cavity, said driven member having a steam passage therethrough which, when adjacent said first opening, connects said intake means with said chamber and when adjacent said second opening, connects said exhaust means with said chamber, valve means interposed between said cavity wall and said intake and exhaust means at said first and second openings, respectively, a steam driven motor operatively connected to said valve means to move said relative to said housing to vary the size of said first and second openings, respectively, and output shaft rotatably mounted within said housing and operatively connected to said driven member to be driven thereby.

37. The steam engine of claim 36 wherein said cavity is spherical and said valve means is arcuate.

* * * * *